US011507005B2

(12) United States Patent
Morino

(10) Patent No.: US 11,507,005 B2
(45) Date of Patent: Nov. 22, 2022

(54) IMAGE FORMING APPARATUS AND METHOD OF FORMING AN IMAGE

(71) Applicant: TOSHIBA TEC KABUSHIKI KAISHA, Tokyo (JP)

(72) Inventor: Shigeru Morino, Numazu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/411,264

(22) Filed: Aug. 25, 2021

(65) Prior Publication Data

US 2022/0091545 A1 Mar. 24, 2022

Related U.S. Application Data

(63) Continuation of application No. 17/029,464, filed on Sep. 23, 2020, now Pat. No. 11,131,950.

(51) Int. Cl.
*G03G 15/20* (2006.01)

(52) U.S. Cl.
CPC ..... *G03G 15/2053* (2013.01); *G03G 15/205* (2013.01); *G03G 15/2064* (2013.01); *G03G 2215/2038* (2013.01)

(58) Field of Classification Search
CPC ..... G03G 15/2039; G03G 15/2042; G03G 15/205; G03G 15/2053; G03G 15/2064; G03G 2215/2038
See application file for complete search history.

(56) References Cited

U.S. PATENT DOCUMENTS 11,250,302 B1 * 2/2022 Kinouchi ..... G03G 15/205
2016/0274510 A1 9/2016 Hase et al.
2019/0121267 A1 4/2019 Miyauchi et al.

FOREIGN PATENT DOCUMENTS

JP 2002-082568 A 3/2002

OTHER PUBLICATIONS

Non-Final Office Action on U.S. Appl. No. 17/029,464 dated Feb. 3, 2021.
Notice of Allowance on U.S. Appl. No. 17/029,464 dated Jun. 11, 2021.

* cited by examiner

*Primary Examiner* — Sophia S Chen
(74) *Attorney, Agent, or Firm* — Foley & Lardner LLP

(57) ABSTRACT

According to one embodiment, an image forming apparatus includes a sheet supply unit, a printer, a fixing device, and a controller. The sheet supply unit supplies a sheet from a sheet container. The printer forms a toner image to the sheet conveyed from the sheet supply unit. The fixing device includes a heater, a fixing belt, and a pressure roller. The heater includes a heat generating member including a plurality of heating elements arranged in a first direction orthogonal to a sheet conveyance direction and in which a heating element group selected in response to a printing request from the heat generating member generates heat. The fixing belt fixes the toner image heated by the heater to the sheet. The pressure roller presses the fixing belt.

19 Claims, 7 Drawing Sheets

IMAGE FORMING APPARATUS AND METHOD OF FORMING AN IMAGE

CROSS-REFERENCE TO RELATED APPLICATION

This application is a continuation of U.S. patent application Ser. No. 17/029,464, filed Sep. 23, 2020, the entire contents of which are incorporated herein by reference.

FIELD

Embodiments described herein relate generally to an image forming apparatus and a method of forming an image.

BACKGROUND

In the related art, image forming apparatuses in an electrophotographic scheme include a fixing device that heats toner and fixes the toner on a sheet. The fixing device includes a heat generating unit including a plurality of heat elements in a sheet width direction. In the fixing device, it is required to heat the heating unit to the fixing temperature of the toner during printing. Immediately after starting warming up the heating unit, the heat of the heating unit more easily escapes from the end portion of the heating unit than from the central portion of the heating unit. Therefore, even if the central portion of the heating unit reaches a predetermined temperature (fixing temperature), end portions of the heating unit do not reach the fixing temperature, and it is likely that fixing failure occurs. Meanwhile, when waiting until the entire area of the heating unit reaches the fixing temperature, it takes a long period of time until the printing starts.

DETAILED DESCRIPTION

Figure 1:
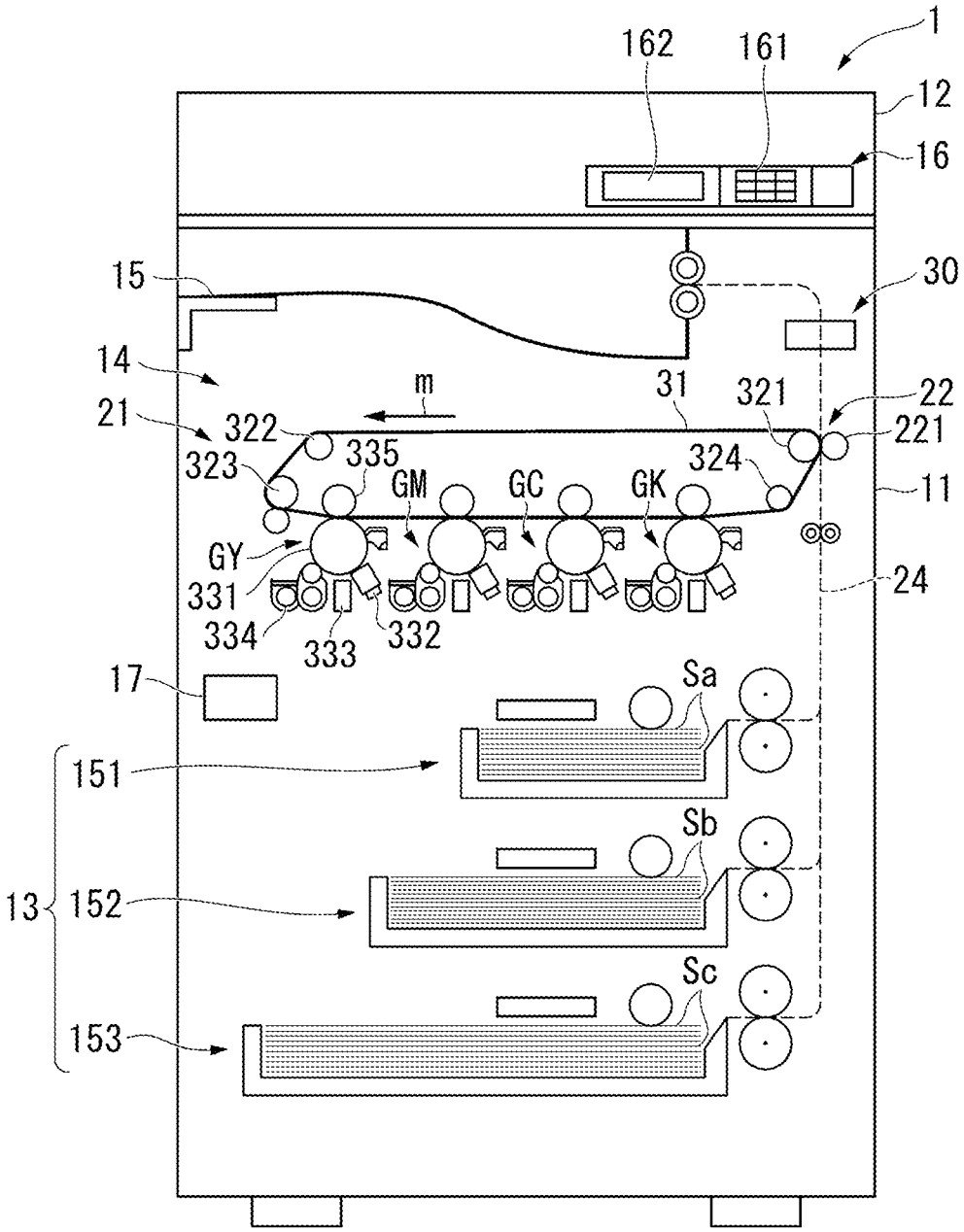
FIG. 1 is a front view illustrating the entire configuration of an image forming apparatus of an embodiment.

In general, according to one embodiment, an image forming apparatus includes a sheet supply unit, a printer, a fixing device, and a controller. The sheet supply unit includes a sheet container. The sheet supply unit is configured to supply a sheet from the sheet container in a sheet conveyance direction. The printer is configured to form a toner image to the sheet supplied from the sheet supply unit. The fixing device includes a heater, a fixing belt, and a pressure roller. The heater is configured to heat the toner image and includes a heat generating member having a plurality of heating elements arranged in a first direction that is orthogonal to the sheet conveyance direction. The plurality of heating elements includes a first end heating element positioned at a first end of the first direction and a second end heating element positioned at a second end of the first direction opposite to the first end. The fixing belt is configured to fix the toner image to the sheet after the toner image is heated by the heater. The pressure roller is configured to apply a pressure to the fixing belt. The controller is configured to receive a printing request. The controller is also configured to select, after receiving the printing request, a heating element group from the plurality of heating elements. The heating element group includes the first end heating element and the second end heating element. The controller is also configured to control the printer so that the toner image is formed in an area between the first end heating element and the second end heating element and for a predetermined period of time from a start of heat generation by the heating element group.

Hereinafter, a paper feeding device and an image forming apparatus according to the embodiment are described with reference to the drawings. In each drawing, the same configuration is denoted by the same reference numeral.

First Embodiment

FIG. 1 is a front view illustrating the entire configuration of the image forming apparatus of an example embodiment. For example, an image forming apparatus 1 is a multifunction peripheral (MFP). However, the image forming apparatus 1 is not limited to the above example and may be a copying machine, a printer, or the like.

As illustrated in FIG. 1, the image forming apparatus 1 includes a housing 11, a scanner unit 12 (scanner), a sheet supply unit 13 (sheet supplier), a printer unit 14 (printer), a paper discharge unit 15 (paper discharger), and a control panel 16.

The housing 11 forms an outer frame of the image forming apparatus 1. The housing 11 contains the scanner unit 12, the sheet supply unit 13, and the printer unit 14.

The scanner unit 12 reads an image to be read based on a brightness of light and a darkness of light. The scanner unit 12 generates and records image information indicating the read image. The scanner unit 12 outputs generated image information to the printer unit 14. The recorded image information may be transmitted to an external device or the like via a network. The sheet supply unit 13 supplies sheets S, which are sheet-like recording media such as paper, one by one to a conveyance path 24 at the timing when the printer unit 14 forms a toner image. According to the present embodiment, the sheet supply unit 13 supplies any one of a sheet Sa, a sheet Sb, or a sheet Sc to the conveyance path 24 as the sheet S. According to the present embodiment, a conveyance direction of the sheet S by the sheet supply unit 13 is referred to as a "sheet conveyance direction." The sheet supply unit 13 according to the embodiment has paper feed cassette units for containing sheets S, including a first cassette (or cassette unit) 151, a second cassette 152, and a third cassette 153. The first cassette 151 contains the plurality of sheets Sa. The second cassette 152 contains the plurality of sheets Sb. The sheets Sa and Sb are A4-sized sheets.

According to the present embodiment, the paper feed cassette units collectively correspond to a "sheet container." The first cassette 151 corresponds to a "first sheet container."

The second cassette 152 corresponds to a "second sheet container." The sheets Sa and Sb correspond to "first sheets." The first cassette 151 contains the sheet Sa so that a short direction of the A4-sized sheet Sa is aligned (e.g., agrees, etc.) with the sheet conveyance direction. The sheet Sa is conveyed in the sheet conveyance direction as the short direction. Hereinafter, a method of performing conveyance so that the sheet conveyance direction is the short direction of the sheet is referred to as "horizontal feeding conveyance." The second cassette 152 contains the sheet Sb so that the long direction of the A4-sized sheet Sb is aligned with the sheet conveyance direction. The sheet Sb is conveyed in the sheet conveyance direction as the long direction. Hereinafter, a method of performing conveyance so that the sheet conveyance direction is the long direction of the sheet is referred to as "longitudinal feeding conveyance."

The third cassette 153 contains the plurality of sheets Sc. The sheet Sc is a A3-sized sheet which is larger than the sheets Sa and Sb. According to the present embodiment, the sheet Sc corresponds to a "second sheet."

The third cassette 153 contains the sheet Sc so that the long direction of the A3-sized sheet Sc is aligned with the sheet conveyance direction. The sheet Sc is conveyed by the longitudinal feeding conveyance in which the sheet conveyance direction is the long direction.

The length of the A4-sized sheets Sa and Sb in the short direction is shorter than the length of the short direction with respect to the A3-sized sheet Sc. In the same manner, the length of the long direction with respect to the A4-sized sheets Sa and Sb is shorter than the length of the long direction with respect to the A3-sized sheet Sc.

The sheet supply unit 13 supplies a predetermined sheet S from the paper feed cassette units to the conveyance path 24 in response to the instruction from a controller 17.

The printer unit 14 forms a toner image to the sheet S conveyed by the sheet supply unit 13. The printer unit 14 forms a toner image which is an output image by a recording agent such as a toner to the sheet S based on the image information acquired from the scanner unit 12 or an external device.

In the embodiment, for convenience of description, the printer unit 14 of the intermediate transfer method is exemplified and described. However, the configuration of the embodiment can be applied to an image forming apparatus including an image forming unit having a direct transfer method. The printer unit includes an intermediate transfer unit 21, a secondary transfer unit 22, a fixing device 30, and the conveyance path 24.

The intermediate transfer unit 21 includes an intermediate transferring belt 31, a plurality of rollers 321, 322, 323, and 324, and a plurality of image forming units GY, GM, GC, and GK.

The intermediate transferring belt 31 is formed in an endless shape. The plurality of rollers 321, 322, 323, and 324 support the intermediate transferring belt 31. Accordingly, the intermediate transferring belt 31 can endlessly run in a direction indicated by an arrow m in FIG. 1.

The plurality of image forming units GY, GM, GC, and GK include a yellow image forming unit GY, a magenta image forming unit GM, a cyan image forming unit GC, and a black image forming GK. Each of the image forming units GY, GM, GC, and GK includes a photosensitive drum 331, a charging charger 332, an exposure unit 333, a developing device 334, and a transfer roller 335. Each of the image forming units GY, GM, GC, and GK transfers the toner image formed on the surface of the photosensitive drum 331 to the intermediate transferring belt 31.

The secondary transfer unit 22 includes a transfer roller 221. The transfer roller 221 is in contact with the outer surface of the intermediate transferring belt 31. One belt roller 321 that supports the intermediate transferring belt 31 is included in the component of the secondary transfer unit 22. The sheet S is interposed between the transfer roller 221 and the belt roller 321 together with the intermediate transferring belt 31. Accordingly, the toner image on the intermediate transferring belt 31 is transferred to the sheet S.

The fixing device 30 heats and presses the toner image transferred to the sheet S and fixes the toner image to the sheet S. Details of the fixing device 30 are described below.

The conveyance path 24 extends from the sheet supply unit 13 to the paper discharge unit 15 via the secondary transfer unit 22 and the fixing device 30. The sheet S moves from the sheet supply unit 13 to the paper discharge unit 15 passing through the secondary transfer unit 22 and the fixing device 30 by being conveyed by the conveyance path 24. The paper discharge unit 15 discharges the sheet S on which an image is formed by the printer unit 14.

The control panel 16 includes a panel 161 and a display 162. The panel 161 receives input of various operation instructions. For example, the display 162 is an image display device such as a liquid crystal display (LCD) or an organic electro luminescence (EL) display. The display 162 displays various kinds of information relating to the image forming apparatus 1. The display 162 displays, for example, an operation mode of the image forming apparatus 1 selected by a user. According to the present embodiment, the control panel 16 corresponds to an input unit (e.g., the control panel 16 can be utilized to receive an input from a user for controlling the image forming apparatus 1, etc.).

The image forming apparatus 1 designates an operation mode by, for example, performing an operation input by pressing an input button or the like included on the panel 161. Otherwise, the user may designate an operation mode of the image forming apparatus 1 by performing an operation input, for example, by tapping an icon or the like displayed on a touch panel configured integrally with the display 162 and the panel 161. The controller 17 controls each unit of the image forming apparatus 1. Details of the controller 17 are described below.

Figure 2:
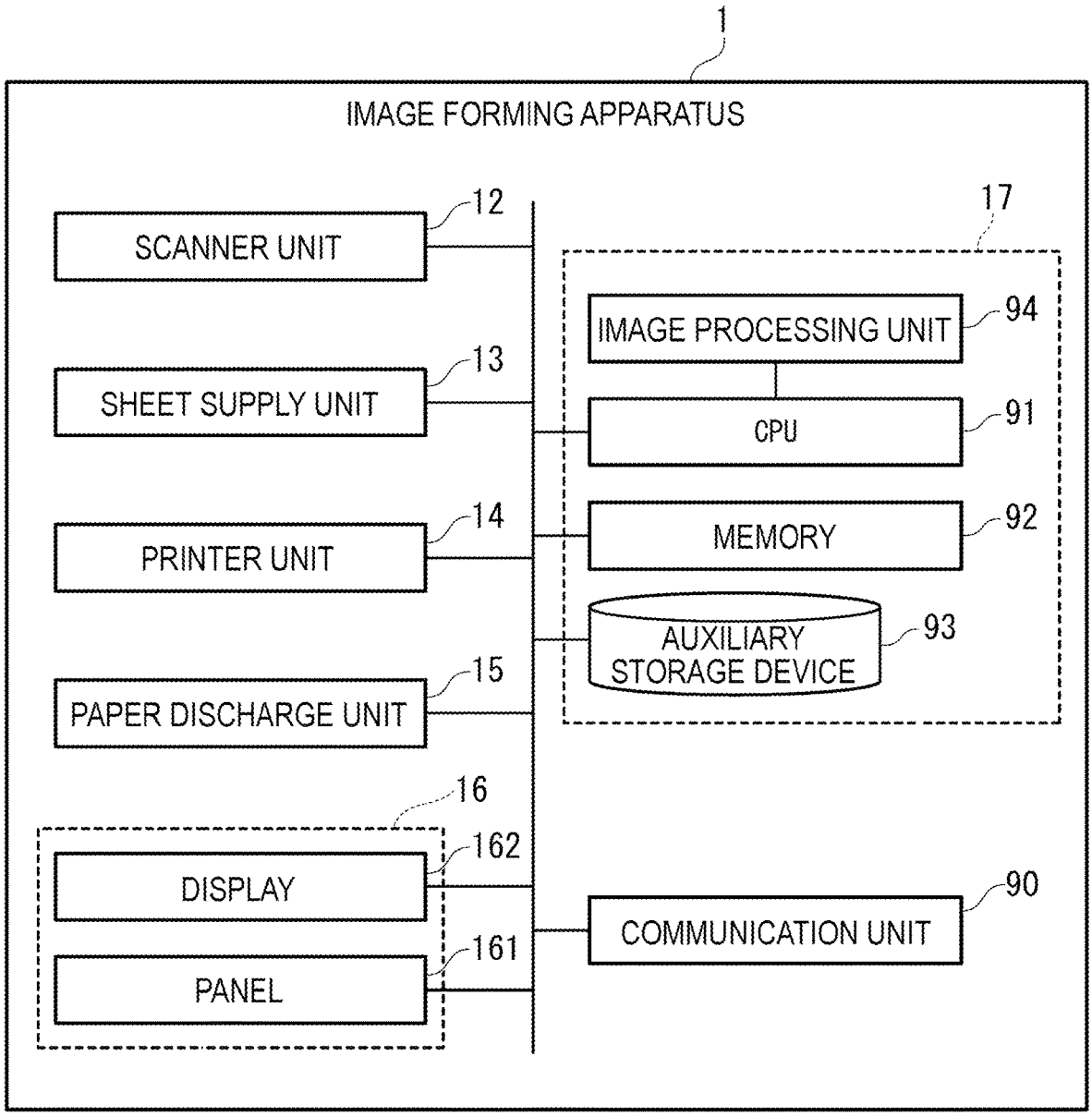
FIG. 2 is a diagram illustrating a hardware configuration of the image forming apparatus shown in FIG. 1.

FIG. 2 is a diagram illustrating a specific example of hardware configuration of the image forming apparatus 1. The image forming apparatus 1 includes a central processing unit (CPU) 91, a memory 92, an auxiliary storage device 93 and the like which are connected via a bus and execute a program. The image forming apparatus 1 functions as a device including the scanner unit 12, the sheet supply unit 13, the printer unit 14, the paper discharge unit 15, the control panel 16, and a communication unit 90 by executing a program. All or a portion of each function of the image forming apparatus 1 may be realized by hardware such as an application specific integrated circuit (ASIC), a programmable logic device (PLD), or a field programmable gate array (FPGA). The program may be recorded on a computer-readable recording medium. Examples of the computer-readable recording medium include a portable medium such as a flexible disk, a magneto-optical disk, a read-only memory (ROM), a compact disc-read-only memory (CD-ROM), and a storage device such as a hard disk built in the computer system. The program may be transmitted via a telecommunication line. The CPU 91 functions as the controller 17 by executing a program stored in the memory 92 and/or the auxiliary storage device 93. The controller 17 controls an operation of each functional unit of the image forming apparatus 1. The controller 17 includes an image processing unit 94. The image processing unit 94 is connected to the CPU 91. The auxiliary storage device 93 is configured by using a storage device such as a magnetic hard disk device or a semiconductor storage device. The auxiliary storage device 93 stores various kinds of information relating to the image forming apparatus 1. The communication unit 90 is configured to include a communication interface for connecting its own device to an external device. The communication unit 90 communicates with the external device via the communication interface.

Hereinafter, the configuration of the fixing device 30 of the embodiment is specifically described.

Figure 3:
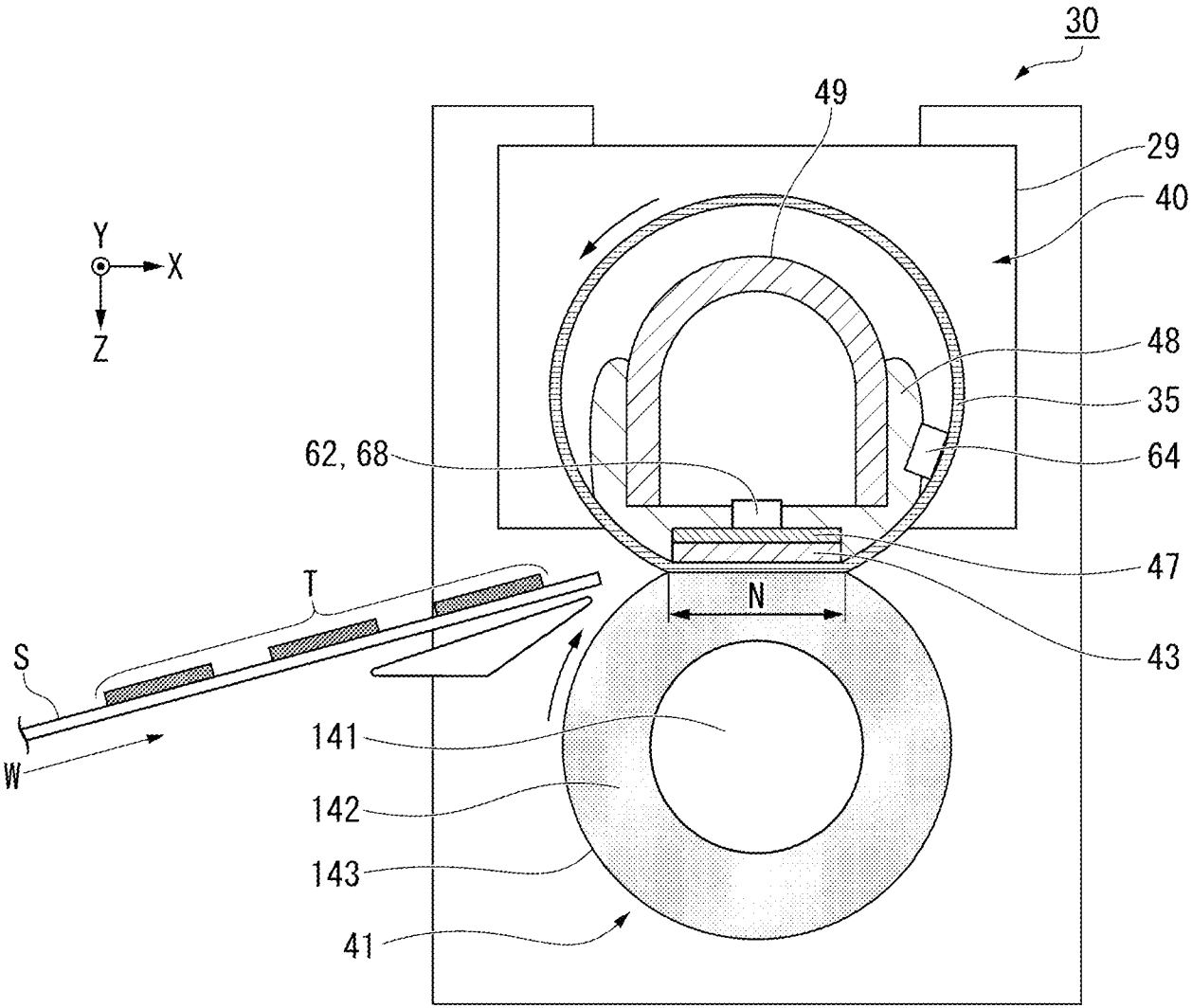
FIG. 3 is a cross-sectional view of a fixing device of the image forming apparatus shown in FIG. 1, seen in the long direction.

FIG. 3 is a cross-sectional view of the fixing device 30 seen in the long direction. The fixing device 30 includes a fixing belt unit 40 (fixing belt) and the pressure roller 41.

As illustrated in FIG. 3, the fixing belt unit 40 forms a nip N with the pressure roller 41. The fixing belt unit 40 heats a toner image T of the sheet S entering the nip N. The fixing belt unit 40 includes the fixing belt 35, a heater unit (heater), a first temperature detecting member 62 (first temperature detector), a thermostat unit 68 (thermostat), a second temperature detecting member 64 (second temperature detector), a heat conducting member 47, a support member 48, and a stay 49.

Hereinafter, an XYZ coordinate system may be used in the description of the configuration of the fixing device 30.

According to the embodiment, an X direction, a Y direction, a Z direction are defined as below. The X direction corresponds to a direction along the short direction of the heater unit 43. The Y direction corresponds to a direction parallel to a width direction of the fixing belt unit 40 and the pressure roller 41. According to the present embodiment, the Y direction corresponds to the main scanning direction and is orthogonal to a conveyance direction W of the sheet S. The Z direction corresponds to the direction orthogonal to the X direction and the Y direction. According to the present embodiment, the main scanning direction corresponds to a "first direction."

The fixing belt 35 includes an endless peripheral surface. The fixing belt 35 is formed in a tubular shape. The fixing belt 35 includes a base layer, an elastic layer, and a release layer in an order from the inner peripheral side. The base layer is formed in the tubular shape. The elastic layer is disposed by being laminated on the outer peripheral surface of the base layer. The elastic layer is formed with an elastic material such as rubber. The release layer is disposed by being laminated on the outer peripheral surface of the elastic layer. The release layer is formed with a material such as perfluoroalkoxy (PFA) resin.

The heater unit 43 is disposed on the inner side of the fixing belt 35. The heater unit 43 heats the fixing belt 35. The fixing belt 35 fixes the toner image T heated by the heater unit 43 to the sheet S. According to the present embodiment, the heater unit 43 corresponds to a "heating unit."

As illustrated in FIG. 3, the heater unit 43 is disposed on the inner side of the fixing belt 35. The inner peripheral surface of the fixing belt 35 is coated with a lubricant (not illustrated). The heater unit 43 is in contact with the inner peripheral surface of the fixing belt 35 via the lubricant. If the heater unit 43 generates heat, the viscosity of the lubricant decreases. Sliding properties between the heater unit 43 and the fixing belt 35 are secured. The fixing belt 35 is a strip-like thin film that is in contact with the heater unit 43 on one surface thereof and slides on the surface of the heater unit 43.

The heat conducting member 47 is formed with metal material having a high heat conductivity such as copper. The outer shape of the heat conducting member 47 is the same as the outer shape of the heater unit 43. The heat conducting member 47 is disposed in contact with the surface of the heater unit 43 on the −Z side. The heat conducting member 47 functions to distribute heat produced by the heater unit 43.

The support member 48 is formed with resin material such as a liquid crystal polymer. The support member 48 is disposed to cover the −Z side of the heater unit 43 and both sides thereof in the X direction. The support member 48 supports the heater unit 43 via the heat conducting member 47. Round chamfers are formed on the both end portions of the support member 48 in the X direction. The support member 48 supports the inner peripheral surface of the fixing belt 35 in the both end portions of the heater unit 43 in the X direction.

The stay 49 is formed with steel plate material or the like. The cross section of the stay 49 along the XZ plane is formed in a U shape. The stay 49 is mounted on the −Z side of the support member 48 so that the U-shaped opening is closed by the support member 48. The stay 49 extends in the Y direction. The both end portions of the Y direction with respect to the stay 49 are fixed to a housing of the image forming apparatus 1. Accordingly, the fixing belt unit 40 is supported by the image forming apparatus 1. The stay 49 improves the bending rigidity of the fixing belt unit 40. A flange 29 that regulates the movement of the Y direction with respect to the fixing belt 35 is mounted in the vicinity of the both end portions of the stay 49 in the Y direction.

A pressure roller 41 presses the toner image T of the sheet S entering the nip N. The pressure roller 41 rotates to convey the sheet S. The pressure roller 41 includes core metal 141, an elastic layer 142, and a release layer 143. The pressure roller 41 can be rotationally driven while pressing the surface of the fixing belt 35.

The core metal 141 is formed, for example, into a columnar shape by using metal material such as stainless steel. Both of the end portions of the axial direction with respect to the core metal 141 are rotatably supported by the housing 11. The core metal 141 is rotationally driven by a motor (not illustrated). The core metal 141 is in contact with a cam member (not illustrated). The cam member rotates to move the core metal 141 towards (e.g., closer to, etc.) and away from the fixing belt unit 40.

The elastic layer 142 is formed with an elastic material such as silicone rubber. The elastic layer 142 is formed on the outer peripheral surface of the core metal 141 in a constant thickness. The release layer 143 is formed with resin material such as PFA (e.g., tetrafluoroethylene/perfluoroalkyl vinyl ether copolymer, etc.). The release layer is formed on the outer peripheral surface of the elastic layer 142. The hardness of the outer peripheral surface of the pressure roller 41 is preferably 40° to 70° under a load of 9.8 Newtons (N) with an ASKER-C hardness meter. Accordingly, the area of the nip N and the durability of the pressure roller 41 are secured.

The pressure roller 41 can be brought towards (e.g., come close to, etc.) and brought away from the fixing belt unit 40 by the rotation of the cam member. If the pressure roller 41 is brought close to the fixing belt unit 40 and pressed by the pressure spring, the nip N is formed. Meanwhile, if the sheet S is jammed in the fixing device 30, the sheet S can be removed by causing the pressure roller 41 to be brought away from the fixing belt unit 40. When the rotation of the fixing belt 35 is stopped during sleeping or the like, plastic deformation of the fixing belt 35 is prevented by causing the pressure roller 41 to go away from the fixing belt unit 40.

The pressure roller 41 is driven to rotate by a motor. If the pressure roller 41 rotates in a state in which the nip N is formed, the fixing belt 35 of the fixing belt unit 40 is driven to rotate. The pressure roller 41 rotates in a state in which the sheet S is disposed in the nip N to convey the sheet S in the conveyance direction W.

Figure 4:
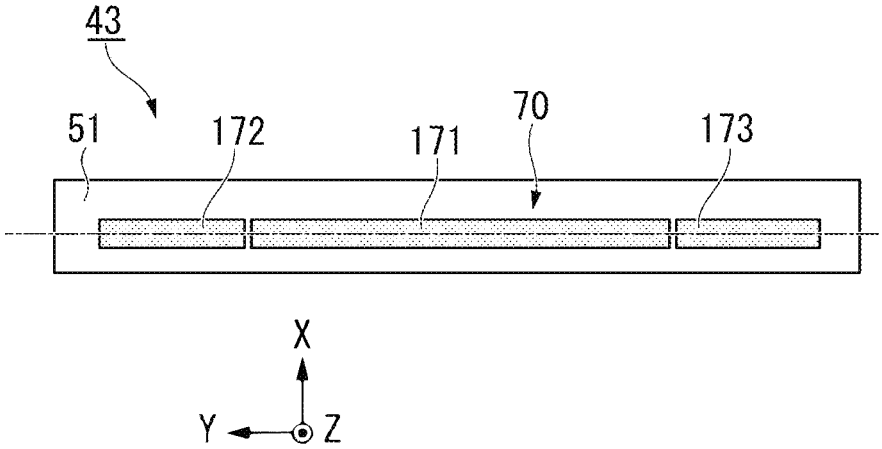
FIG. 4 is a bottom view of a heater unit of the image forming apparatus shown in FIG. 1.

FIG. 4 is a bottom view of the heater unit 43.

As illustrated in FIG. 4, the heater unit 43 includes a substrate 51 and a heat generating member 70. The substrate is formed with metal material such as stainless steel or ceramic material such as aluminum nitride. The substrate 51 is formed in a long and thin rectangular plate shape along the Y axis. The substrate 51 is disposed on the inner side of the radial direction with respect to the fixing belt 35. The substrate 51 has the axial direction of the fixing belt 35 as the long direction.

The heat generating member 70 is provided on a surface of one side (e.g., the +Z side, etc.) of the substrate 51 via an insulating layer such as a glass material. The heat generating member 70 is formed of temperature coefficient of resistance (TCR) material. For example, the heat generating member 70 may be formed of a silver-palladium alloy or the like. The outer shape of the heat generating member 70 is a rectangular shape having a long side along the Y direction and a short side along the X direction.

The heat generating member 70 includes a central portion heating element 171, a first end portion heating element 172, and a second end portion heating element 173 as a plurality of heating elements. The central portion heating element 171, the first end portion heating element 172, and the second end portion heating element 173 are arranged along the Y direction. The heater unit 43 is provided with a protective layer by a glass material or the like to cover the heat generating member 70. The protective layer improves the sliding properties between the heater unit 43 and the fixing belt 35.

In the present embodiment, the heat generating member 70 heats a heating element group selected in response to a type of printing request. The heating element group is selected from the central portion heating element 171, the first end portion heating element 172, and the second end portion heating element 173 in response to the type of the printing request. The type of the printing request is, for example, information relating to a kind of the printing sheet S (any one of the sheets Sa, Sb, and Sc) or the conveyance direction of the sheet S (sheet direction) with respect to the fixing device 30.

The central portion heating element 171 is disposed in the central portion of the Y direction with respect to the heat generating member 70. The central portion heating element 171 may be configured in combination with a plurality of small heating elements disposed by being arranged in the Y direction.

The first end portion heating element 172 is disposed on an end portion which is the +Y side of the central portion heating element 171 and the +Y side of the heat generating member 70. The second end portion heating element 173 is disposed on the end portion which is the −Y side of the central portion heating element 171 and the −Y side of the heat generating member 70. The boundary line between the central portion heating element 171 and the first end portion heating element 172 may be disposed in parallel to the X direction and may be disposed to intersect in the X direction. The boundary line between the central portion heating element 171 and the second end portion heating element 173 is provided in the same manner. The first end portion heating element 172 and the second end portion heating element 173 may be configured in combination with a plurality of small heating elements disposed by being arranged in the Y direction.

The heat generating member 70 generates heat by energization. The central portion heating element 171, the first end portion heating element 172, and the second end portion heating element 173 can be independently controlled to generate heat by the controller 17.

Figure 5:
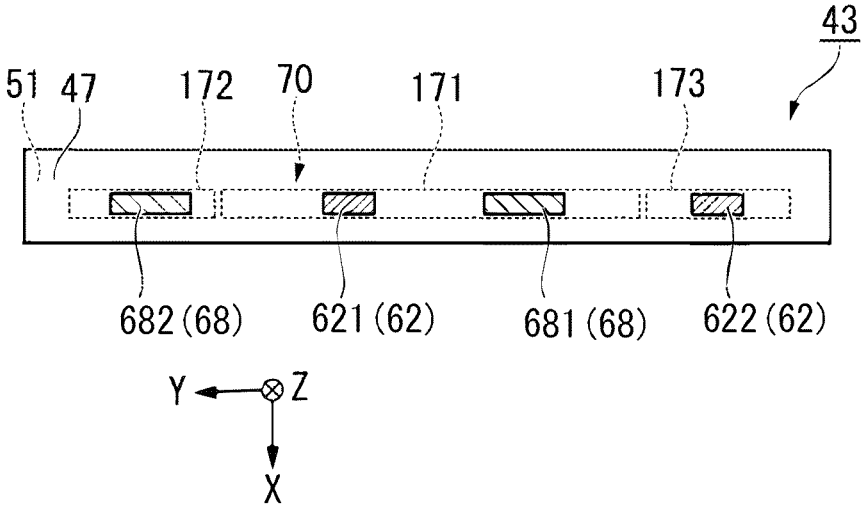
FIG. 5 is a plan view of a first temperature detecting member and a thermostat unit of the image forming apparatus shown in FIG. 1.

FIG. 5 is a plan view (seen from the −Z side) of the first temperature detecting member 62 and the thermostat unit 68. In FIG. 5, the description of the support member 48 is omitted. The description relating to the disposition of the first temperature detecting member 62 and the thermostat unit 68 is to describe the disposition of each temperature sensitive element.

As illustrated in FIG. 5, the first temperature detecting member is disposed on the −Z side of the heater unit 43 with interposing the heat conducting member 47 therebetween. For example, the first temperature detecting member 62 may be a thermistor. The first temperature detecting member 62 is mounted on the surface of the support member 48 on the −Z side and supported. The temperature sensitive element of the first temperature detecting member 62 is in contact with the heat conducting member 47 through the hole penetrating the support member 48 in the Z direction. The first temperature detecting member 62 measures the temperature of the heater unit 43 via the heat conducting member 47.

The first temperature detecting member 62 includes a central portion heater thermometer 621 and an end portion heater thermometer 622 which are disposed by being arranged in the Y direction. The central portion heater thermometer 621 and the end portion heater thermometer 622 are disposed in the area of the Y direction with respect to the heat generating member 70. The central portion heater thermometer 621 and the end portion heater thermometer 622 are disposed in the center of the X direction with respect to the heat generating member 70. Seen in the Z direction, the central portion heater thermometer 621 and the end portion heater thermometer 622 are overlapped with the heat generating member 70 in at least a portion thereof. In the first temperature detecting member 62, the central portion heater thermometer 621 measures the temperature of the central portion heating element 171. The central portion heater thermometer 621 is disposed in the area of the central portion heating element 171. Seen in the Z direction, the central portion heater thermometer 621 and the central portion heating element 171 are overlapped with each other.

In the first temperature detecting member 62, the end portion heater thermometer 622 measures the temperature of the second end portion heating element 173. The first end portion heating element 172 and the second end portion heating element 173 control the heat generation in the same manner as the controller 17, and thus the temperature of the first end portion heating element 172 and the temperature of the second end portion heating element 173 are the same. The end portion heater thermometer 622 is disposed in the area of the second end portion heating element 173. Seen in the Z direction, the end portion heater thermometer 622 and the second end portion heating element 173 are overlapped with each other. The end portion heater thermometer 622 may be independently provided to measure the temperature of the first end portion heating element 172.

If the temperature of the heater unit 43 which is detected via the heat conducting member 47 exceeds a predetermined temperature (e.g., a threshold temperature, etc.), the thermostat unit 68 cuts off the energization to the heat generating member 70. The thermostat unit 68 includes a central portion thermostat 681 and an end portion thermostat 682. The thermostat unit 68 is also disposed in the same manner as the first temperature detecting member 62 described above.

If the temperature of the central portion heating element 171 exceeds a predetermined temperature (e.g., a threshold temperature, etc.), the central portion thermostat 681 cuts off the energization to the heat generating member 70. The central portion thermostat 681 is disposed in the area of the central portion heating element 171. Seen in the Z direction, the central portion thermostat 681 and the central portion heating element 171 are overlapped with each other.

If the temperature of the first end portion heating element 172 exceeds the predetermined temperature, the end portion thermostat 682 cuts off the energization to the heat generating member 70. The first end portion heating element 172 and the second end portion heating element 173 control the heat generation in the same manner, and thus the temperature of the first end portion heating element 172 and the temperature of the second end portion heating element 173 are the same. The end portion thermostat 682 is disposed in the area of the first end portion heating element 172. Seen in the Z direction, the end portion thermostat 682 and the first end portion heating element 172 are overlapped with each other.

In the heater unit 43 of the present embodiment, the central portion heater thermometer 621 and the central portion thermostat 681 are disposed in the area of the central portion heating element 171, and thus control the temperature of the central portion heating element 171. In the heater unit 43 of the present embodiment, the end portion heater thermometer 622 and the end portion thermostat 682 are disposed in the areas of the first end portion heating element 172 and the second end portion heating element 173 and thus control the temperature of the first end portion heating element 172 and the second end portion heating element 173.

As illustrated in FIG. 3, the second temperature detecting member 64 is disposed on the +X side on the inner side of the fixing belt 35. The second temperature detecting member 64 is in contact with the inner peripheral surface of the fixing belt 35 and measures the temperature of the fixing belt 35.

Hereinafter, an example of the operation of the image forming apparatus 1 of the present embodiment is described.

Figure 6:
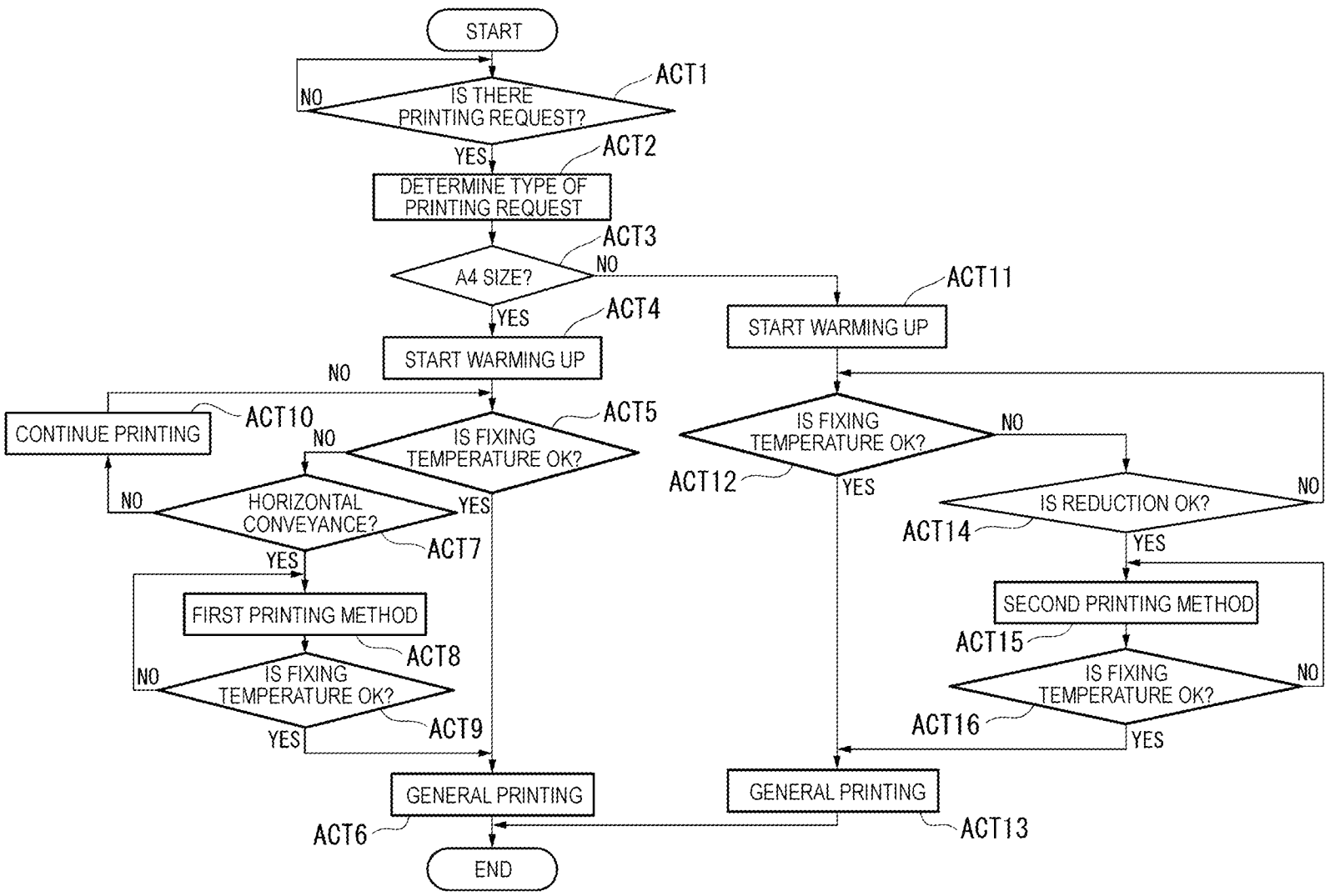
FIG. 6 is a flowchart illustrating an example of an operation of the image forming apparatus shown in FIG. 1.

FIG. 6 is a flowchart illustrating an example of the operation of the image forming apparatus 1. The present flowchart illustrates an image forming method of the image forming apparatus 1.

As illustrated in FIG. 6, the controller 17 waits for a printing request from the control panel 16 or an externally connected device (ACT 1). When a printing request is received (ACT 1: YES), the controller 17 determines a type of the printing request (ACT 2). The controller 17 acquires a width of a printing sheet in a main scanning direction (the Y direction) as the type of the printing request.

Figure 7:
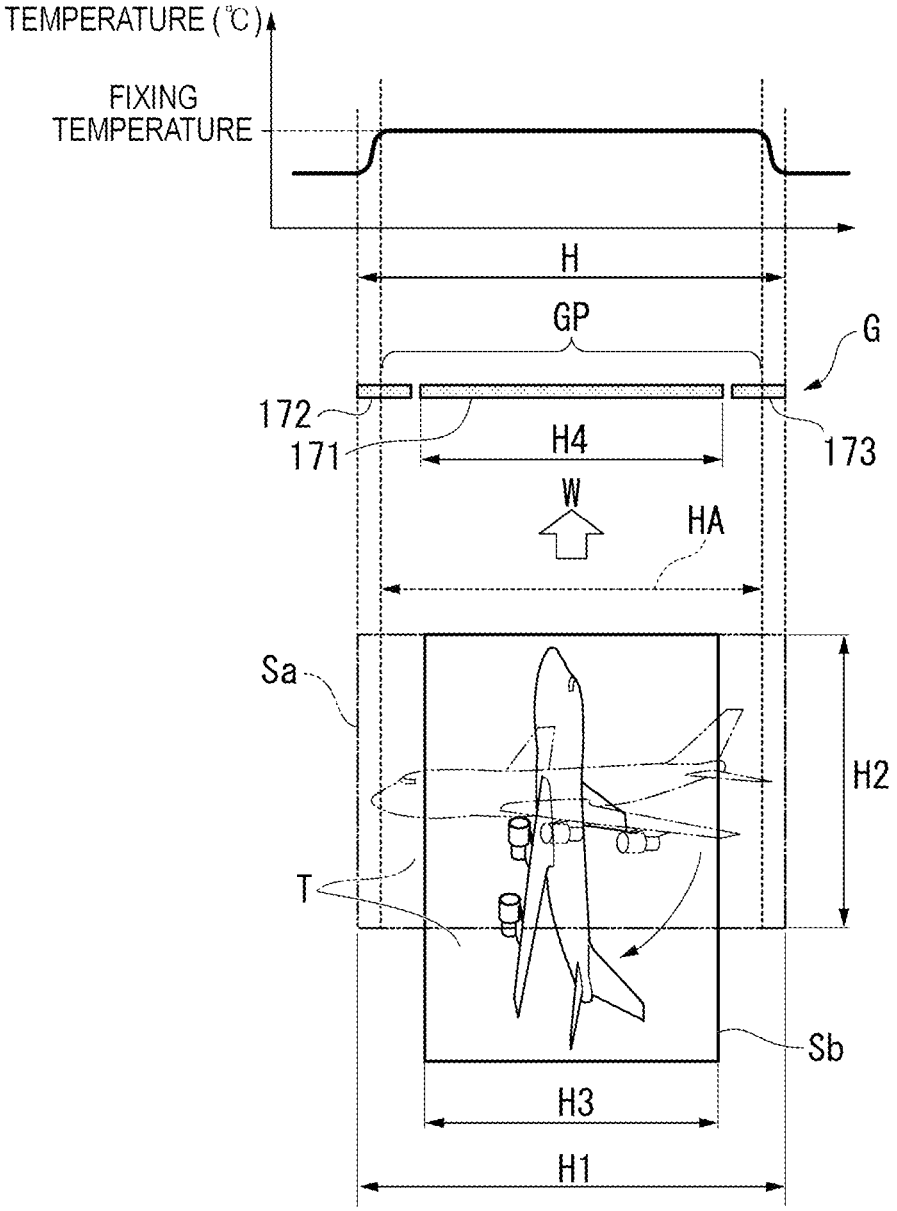
FIG. 7 is a dimension diagram of an A4-sized sheet and a heat generating member of the image forming apparatus shown in FIG. 1.

The controller 17 selects a heating element to be heated as a heating element group in the heat generating member 70 in response to the width of the main scanning direction (the Y direction) with respect to the sheet S in the printing request. FIG. 7 is a diagram illustrating a dimension relationship between the A4-sized sheet Sa and the heat generating member 70. FIG. 7 illustrates the temperature distribution generated in a heating element group G immediately after warming up of the heating element group G is completed.

As illustrated in FIG. 7, the width of the long direction with respect to the A4-sized sheet Sa is identical to or smaller than the width of the main scanning direction with respect to the heat generating member 70. If printing is performed on the sheet Sa, the width H of the heating element group G corresponds to the width of the heat generating member 70 in the main scanning direction. According to the present embodiment, a width H1 of the main scanning direction (width in the long direction) with respect to the sheet Sa is similar to a width H of the main scanning direction with respect to the heating element group G. The width of the short direction with respect to the A4-sized sheet Sa is smaller than the width of the main scanning direction with respect to the heat generating member 70. The relationship between the A4-sized sheet Sb and the heat generating member 70 is described in the same manner.

If printing is requested to the A4-sized sheet Sa or sheet Sb (ACT 3: YES), the controller 17 selects all of the central portion heating element 171, the first end portion heating element 172, and the second end portion heating element 173 as the heating element group G. Hereinafter, the central portion heating element 171, the first end portion heating element 172, and the second end portion heating element 173 are, for the sake of convenience, collectively referred to as the heating elements 171, 172, and 173.

The A4-sized sheet Sa is supplied to the fixing device 30 so that the main scanning direction is the long direction. The A4-sized sheet Sb is supplied to the fixing device 30 so that the main scanning direction is the short direction. Hereinafter, the conveyance form of the sheet Sa to the fixing device 30 is referred to as conveyance in the horizontal direction, and the conveyance form of the sheet Sb to the fixing device 30 is referred to as conveyance in the vertical direction. The controller 17 starts warming up the heating element group G (ACT 4).

Immediately after the start of warming up, as illustrated in FIG. 7, heat easily escapes from the first end portion heating element 172 and the second end portion heating element 173 positioned in the end portions of the heat generating member 70, compared with the central portion heating element 171 positioned in the central portion of the heat generating member 70.

Immediately after the start of warming up, the temperature of the end portions of the first end portion heating element 172 and the second end portion heating element 173 is lower than the temperature of the central portion heating element 171. Immediately after the start of warming up, the temperature unevenness occurs in the heating element group G (e.g., an unequal distribution of heat produced by the heating element group G, etc.). If a fixing process is performed by the heat generating member 70 in which the temperature unevenness is generated, it is likely that the toner image T is not sufficiently fixed on the sheet S so that the fixing failure occurs.

The image forming apparatus 1 of the present embodiment determines whether each of the heating elements 171, 172, and 173 included in the heating element group G reaches the fixing temperature (ACT 5). The controller 17 determines whether the entire heating element group G reaches the fixing temperature. The controller 17 determines whether each of the heating elements 171, 172, and 173 reaches the fixing temperature based on the temperature detection result of the first temperature detecting member 62. If the controller 17 determines that each of the heating elements 171, 172, and 173 reaches the fixing temperature (ACT 5: YES), general printing is performed according to the printing request (ACT 6).

If general printing is performed, for example, the controller 17 controls the printer unit 14 and the sheet supply unit 13 so that the toner image T is formed on the A4-sized sheet Sa conveyed in the horizontal direction. For example, the controller 17 controls the printer unit 14 and the sheet supply unit 13 to form the toner image T on the A4-sized sheet Sb conveyed in the vertical direction.

Meanwhile, if the controller 17 determines that each of the heating elements 171, 172, and 173 does not reach the fixing temperature (ACT 5: NO), the process proceeds to the following step.

For a predetermined period of time from the start of the heating of the selected heating element group G, the controller 17 controls the printer unit 14 and the sheet supply unit 13 so that the toner image is formed in the area on the inner side than the heating elements 172 and 173 positioned at both ends of the main scanning direction (the Y direction) with respect to the selected heating element group G.

Specifically, in the present embodiment, the controller 17 controls the printer unit 14 and the sheet supply unit 13 so that a toner image is formed in the heating area of the portion that generates heat at the fixing temperature in the heating element group G for a period of time until each of the heating elements 171, 172, and 173 included in the heating element group G reaches the fixing temperature.

According to the present embodiment, a width H2 of the short direction with respect to the A4-sized sheet Sa is shorter than the width H of the heating element group G. The controller 17 controls the sheet supply unit 13 so that the A4-sized sheet is supplied to the heat generating member 70 so that the main scanning direction is the short direction. Specifically, the controller 17 controls the sheet supply unit 13 to supply the A4-sized sheet Sb from the second cassette 152.

As illustrated in FIG. 7, a width H3 of the main scanning direction with respect to the sheet Sb is the same as the width H2 of the short direction with respect to the sheet Sa and thus is smaller than the width H of the heat generating member 70. Specifically, the width H3 of the sheet Sb is similar to a width H4 of the main scanning direction with respect to the central portion heating element 171 positioned in the central portion of the heat generating member 70.

Immediately after the warming up, the width of a portion GP that generates heat at the fixing temperature in the heating element group G is larger than the width H3 of the sheet Sb. Immediately after the warming up, the heating element group G can heat the entire width H3 of the sheet Sb conveyed in the vertical direction.

If the printing request is printing on the A4-sized sheet Sa conveyed in the horizontal direction (ACT 7: YES), the controller 17 performs the first printing method (ACT 8). In the first printing method, the controller 17 controls the printer unit 14 and the sheet supply unit 13 so that the toner image T is formed in an area on between the heating elements 172 and 173, which are positioned at both ends of the main scanning direction (the Y direction), in the selected heating element group G.

Specifically, in the first printing method, the controller 17 controls the printer unit 14 and the sheet supply unit 13 to form the toner image T at a position included in a heating area HA of the portion GP that generates heat at the fixing temperature in the heating element group G.

As illustrated in FIG. 7, the direction of the sheet Sa conveyed in the horizontal direction and the direction of the sheet Sb conveyed in the vertical direction are separated by 90°. That is, if the toner image T is formed according to the printing request to the sheet Sb, the direction of forming the toner image T with respect to the sheet Sa may be rotated by 90°.

The controller 17 controls the printer unit 14 and the sheet supply unit 13 to form the toner image rotating by 90° with respect to the A4-sized sheet conveyed in the vertical direction having the main scanning direction as the short direction.

In the present embodiment, the controller 17 transmits a rotation process command for rotating image data with respect to the image processing unit 94. The image processing unit 94 rotates the direction of the image data by 90° according to the rotation process command.

The image processing unit 94 outputs the image data after the rotation process to the CPU 91. The CPU 91 causes the printer unit 14 to print based on the image data after the rotation process.

The controller 17 drives the printer unit 14 to form the toner image T rotating by 90° from the toner image T with respect to the sheet Sa to the A4-sized sheet Sb conveyed in the vertical direction.

As such, the image forming apparatus 1 can perform the printing process for forming the toner image T of which the direction is different by 90° from that of the printing request on the A4-sized sheet Sb conveyed in the vertical direction, as the first printing method.

After the first printing method is performed, the controller 17 determines whether each of the heating elements 171, 172, and 173 included in the heating element group G reaches the fixing temperature (ACT 9). Until the controller 17 determines that each of the heating elements 171, 172, and 173 included in the heating element group G reaches the fixing temperature, the controller 17 controls the printer unit 14 and the sheet supply unit 13 to perform the first printing method (ACT 9: NO, ACT 8). The controller 17 repeats the first printing method different from the printing request for a predetermined period of time until each of the heating elements 171, 172, and 173 reaches the fixing temperature.

Meanwhile, if it is determined that each of the heating elements 171, 172, and 173 included in the heating element group G reaches the fixing temperature (ACT 9: YES), the controller 17 controls the printer unit 14 and the sheet supply unit 13 to switch the process to the general printing process according to the printing request. In the general printing process, the controller 17 controls the printer unit 14 and the sheet supply unit 13 to form the toner image T with respect to the A4-sized sheet Sa conveyed to the horizontal direction (ACT 6).

After the predetermined period of time elapses from the reaching of each of the heating elements 171, 172, and 173 to the fixing temperature, the controller 17 is not required to immediately switch the process to the general printing process. For example, if each of the heating elements 171, 172, and 173 reaches the fixing temperature during a predetermined print job being performed, the controller 17 may switch the process to the general process printing process after the predetermined print job is completed.

After a predetermined period of time elapses from the reaching of each of the heating elements 171, 172, and 173 included in the heating element group G to the fixing temperature, the controller 17 may switch the process to the general printing process at the timing of the break of the print job. Here, since the direction of the sheet S discharged to the paper discharge unit 15 is not changed during the print job, the sheet S discharged to the paper discharge unit 15 can be collected. When printing on the A4-sized sheet Sb conveyed in the vertical direction is requested as the printing request (ACT 7: NO), the controller 17 proceeds to the following step.

Immediately after the warming up, the width of the portion GP that generates the heat at the fixing temperature in the heating element group G is larger than the width H3 of the sheet Sb conveyed in the vertical direction, and the entire width of the sheet Sb can be heated. Accordingly, the controller 17 continues the printing process (ACT 10). The controller 17 controls the printer unit 14 and the sheet supply unit 13 so that the toner image T is formed on the A4-sized sheet Sb conveyed in the longitudinal feeding without change. After the printing process continues, the controller 17 determines whether each of the heating elements 171, 172, and 173 included in the heating element group G reaches the fixing temperature (ACT 5).

Meanwhile, if printing on the A3-sized sheet Sc is requested (ACT 3: NO), the controller 17 selects all of the central portion heating element 171, the first end portion heating element 172, and the second end portion heating element 173 as the heating element group G, and the A3-sized sheet Sc is supplied to the fixing device 30 so that the main scanning direction is the short direction. Hereinafter, the conveyance form of the sheet Sc to the fixing device 30 is referred to as the vertical direction conveyance.

Figure 8:
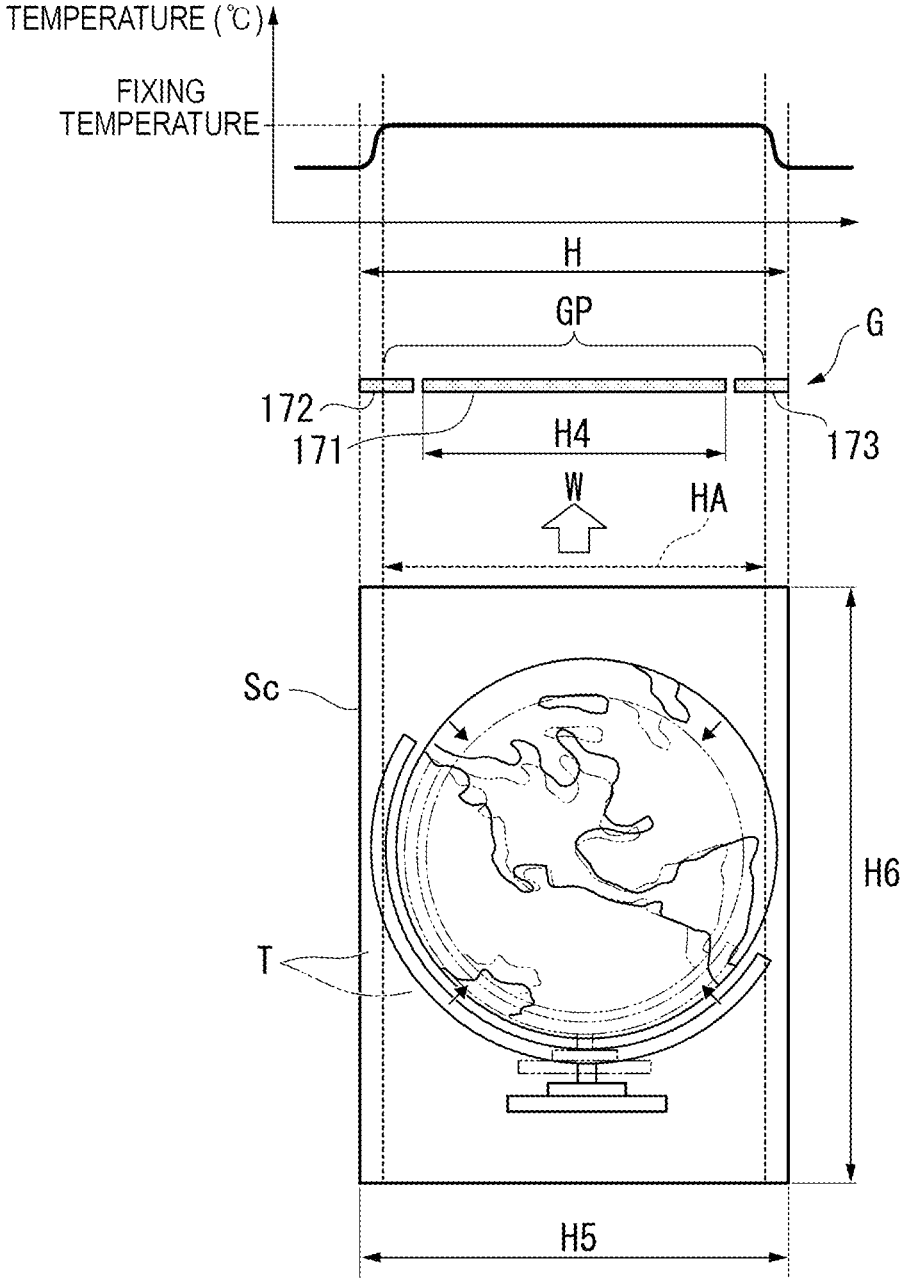
FIG. 8 is a dimension diagram of an A3-sized sheet and the heat generating member shown in FIG. 7.

FIG. 8 is a diagram illustrating a dimension relationship between the A3-sized sheet Sc and the heat generating member 70. FIG. 8 illustrates temperature distribution generated in the heating element group G immediately after the warming up.

As illustrated in FIG. 8, a width H5 of the main scanning direction (the width of the short direction) with respect to the A3-sized sheet Sc is identical to or smaller than the width H of the main scanning direction of the heat generating member 70. According to the present embodiment, the width H5 of the main scanning direction with respect to the sheet Sc is similar to the width H of the main scanning direction in the heat generating member 70 (the heating element group G). A width H6 of the long direction in the sheet Sc is longer than the width H of the main scanning direction with respect to the heat generating member 70.

Meanwhile, if the printing on the A3-sized sheet Sc is requested (ACT 3: NO), the controller 17 selects all of the heating elements 171, 172, and 173 in the heat generating member 70 as the heating element group G.

The controller 17 starts the warming up of the heating element group G (ACT 11). Immediately after the start of warming up, as illustrated in FIG. 8, temperature unevenness occurs in the heat generating member 70.

The image forming apparatus 1 of the present embodiment determines whether each of the heating elements 171, 172, and 173 included in the heating element group G reaches the fixing temperature (ACT 12). The controller 17 determines whether the entire heating element group G reaches the fixing temperature. The controller 17 determines whether each of the heating elements 171, 172, and 173 reaches the fixing temperature based on the temperature detection result of the first temperature detecting member 62. If the controller 17 determines that each of the heating elements 171, 172, and 173 reaches the fixing temperature (ACT 12: YES), the general printing is performed according to the printing request (ACT 13). If the general printing is performed, the controller 17 controls the printer unit 14 and the sheet supply unit 13 so that the toner image T is formed on the A3-sized sheet Sc conveyed in the vertical direction.

Meanwhile, if the controller 17 determines that each of the heating elements 171, 172, and 173 does not reach the fixing temperature (ACT 12: NO), the following step is performed. For the predetermined period of time from the start of the heat generation of the selected heating element group G, the controller 17 controls the printer unit 14 and the sheet supply unit 13 so that the toner image is formed in an area on the inner side than the heating elements 172 and 173 positioned on both ends of the main scanning direction (the Y direction) with respect to the selected heating element group G.

Specifically, according to the present embodiment, the controller 17 controls the printer unit 14 and the sheet supply unit 13 so that the toner image is formed on the heating area of the portion GP that generates heat at the fixing temperature in the heating element group G for a period of time until each of the heating elements 171, 172, and 173 included in the heating element group G reaches the fixing temperature as the predetermined period of time.

Specifically, the controller 17 determines whether the image data in the printing request satisfies a predetermined condition (e.g., a predetermined resolution, a predetermined shape, a predetermined width, etc.). The controller 17 determines whether, when the image data of the printing request is reduced as a result of the predetermined condition being satisfied, there is a problem (e.g., distortion, degradation, etc.) in the image data after reduction (ACT 14). The controller 17 determines whether the image data in the printing request is data that is not influenced by the reduction of characters, pictures, or the like, for example, whether the data is influenced by the reduction of a picture or the like including a square of a predetermined size.

If there is a problem in the image data after reduction, the controller 17 determines that the image data in the printing request cannot be reduced (ACT 14: NO).

Since the width H6 of the long direction with respect to the A3-sized sheet Sc is larger than the width H of main scanning direction with respect to the heat generating member 70, the image forming apparatus 1 of the present embodiment does not print the sheet Sc conveyed in the horizontal direction. If the image data is not reduced, the image forming apparatus 1 waits until each of the heating elements 171, 172, and 173 reaches the fixing temperature (ACT 12, ACT 14).

If there is no problem in the image data after the reduction, the controller 17 determines that the image data in the printing request can be reduced (ACT 14: YES) and performs the second printing method (ACT 15). In the second printing method, the controller 17 controls the printer unit 14 and the sheet supply unit 13 so that the toner image T is formed in the area on the inner side than the heating elements 172 and 173 positioned on both ends of the main scanning direction (the Y direction) in the selected heating element group G.

Specifically, in the second printing method, the controller 17 controls the printer unit 14 and the sheet supply unit 13 so that the toner image T is formed at the position included in the heating area HA of the portion GP that generates heat at the fixing temperature in the heating element group G. The controller 17 controls the printer unit 14 and the sheet supply unit 13 so that the toner image T is reduced and formed with respect to the A3-sized sheet Sc conveyed in the vertical direction.

In the present embodiment, the controller 17 transmits the reduction process command for reducing the image data to the image processing unit 94. The image processing unit 94 reduces the image data according to the reduction process command. A reduced toner image is associated with the reduced image data. The reduced toner image may be the toner image scaled down (e.g., the reduced toner image is uniformly scaled down 80% from the toner image, etc.). The reduced toner image may be a portion of the toner image.

Here, the portion GP including the central portion heating element 171 and the peripheral portion thereof in the heating element group G reaches the fixing temperature even immediately after the warming up. The portion GP in the heating element group G can fix the toner image at the temperature immediately after the warming up. The image processing unit 94 reduces the image data so that the toner image is included in the heating area HA of the portion GP that generates heat at the fixing temperature in the heating element group G according to the reduction process command.

The image processing unit 94 outputs the image data after the reduction process to the CPU 91. The CPU 91 causes the printer unit 14 to print based on the image data after the reduction process. As illustrated in FIG. 8, the controller 17 drives the printer unit 14 so that the toner image is reduced to be included in the heating area HA of the portion GP that generates heat at the fixing temperature in the heating element group G and formed on the sheet Sc.

As such, the image forming apparatus 1 can perform the printing method for forming the toner image T reduced to the A3-sized sheet Sc conveyed in the vertical direction as the second printing method.

The controller 17 determines whether each of the heating elements 171, 172, and 173 included in the heating element group G reaches the fixing temperature after the second printing method is performed (ACT 16). The controller 17 controls the printer unit 14 and the sheet supply unit 13 so that the second printing method is performed until each of the heating elements 171, 172, and 173 included in the heating element group G reaches the fixing temperature (ACT 16: NO). The controller 17 repeats the second printing method different from the printing request for the predetermined period of time until each of the heating elements 171, 172, and 173 reaches the fixing temperature.

Meanwhile, if it is determined that each of the heating elements 171, 172, and 173 included in the heating element group G reaches the fixing temperature (ACT 16: YES), the controller 17 controls the printer unit 14 and the sheet supply unit 13 to switch the process to the general printing process corresponding to the printing request.

In the general printing process, the controller 17 controls the printer unit 14 and the sheet supply unit 13 to form the toner image T on the A3-sized sheet Sc conveyed in the longitudinal feeding (ACT 13).

According to the image forming apparatus 1 of the present embodiment, for the predetermined period of time until the entire heating element group G reaches the fixing temperature, the toner image T can be formed in the heating area HA of the portion GP that generates heat at the fixing temperature in the heating element group G. Accordingly, without waiting until the entire heating element group G reaches the fixing temperature, it is possible to start the printing operation. The toner image T is heated at the fixing temperature, and thus the occurrence of the fixing failure can be prevented. Accordingly, the image forming apparatus 1 of the present embodiment can reduce the waiting time until the start of the printing process, while the occurrence of the fixing failure is prevented.

In response to the input instruction, for the predetermined period of time until the entire heating element group G reaches the fixing temperature, the image forming apparatus 1 of the present embodiment may switch the state to a first state of controlling the printer unit 14 and the sheet supply unit 13 to form the toner image T in the heating area HA and a second state of not performing control. For example, the image forming apparatus 1 switches the state to the first state and the second state in response to the instruction input to the control panel 16.

In the image forming apparatus 1 of the present embodiment, a case of using the A3-sized and A4-sized sheets S is exemplified, but the kind of the sheet S is not limited thereto, and the sheet S of a size other than A3 and A4 may be used.

In the image forming apparatus 1 of the present embodiment, a case of rotating the toner image T or reducing the toner image T is exemplified as the printing method of forming the toner image T in the heating area HA of the portion GP that generates heat at the fixing temperature in the heating element group G, but the embodiment is not limited thereto. For example, the toner image T may be shifted to a position included in the heating area HA of the portion GP that generates heat at the fixing temperature.

In the image forming apparatus 1 of the present embodiment, as the first printing method, a case where the toner image T is rotated by 90° and formed on the sheet Sb conveyed in the vertical direction instead of the sheet Sa conveyed in the horizontal direction, but the embodiment is not limited thereto.

For example, if the reduction of the toner image T is accepted in the sheet Sa conveyed in the horizontal direction, the image data may be reduced so that the toner image T is included in the heating area HA of the portion GP that generates heat at the fixing temperature in the heating element group G for a period of time until the entire heating element group G reaches the fixing temperature.

Hereinafter, a method of forming an image by using the image forming apparatus 1 of the embodiment is described.

The method of forming an image according to the present embodiment includes a step of forming the toner image T by the printer unit 14 on the sheet S supplied from the sheet supply unit 13, a step of driving the heating element group G selected in response to a printing request from the plurality of heating elements 171, 172, and 173 arranged in the main scanning direction orthogonal to the sheet conveyance direction from the printer unit 14 to heat the fixing belt 35 and fixing the toner image T to the sheet S, and a step of controlling the printer unit 14 so that the toner image T is formed in an area on the inner side than the heating elements 172 and 173 positioned at both ends of the main scanning direction in the selected heating element group G for a predetermined period of time from the start of the heat generation of the selected heating element group G.

According to the corresponding method of forming an image, for a predetermined period of time until the entire heating element group G reaches the fixing temperature, the toner image T can be formed in the heating area HA on the inner side than the heating elements 172 and 173 positioned at both ends of the main scanning direction with respect to the heating element group G. Accordingly, the printing operation can be started without waiting until the entire heating element group G reaches the fixing temperature. Since the toner image T is heated at the fixing temperature, the occurrence of the fixing failure is prevented. Accordingly, image printing in which the waiting time until the printing process starts is reduced while the occurrence of the fixing failure is prevented can be performed.

While certain embodiments have been described, these embodiments have been presented byway of example only, and are not intended to limit the scope of the embodiments described herein. Indeed, the embodiments described herein may be embodied in a variety of other forms. Furthermore various omissions, substitutions, and changes in the form of the embodiments described herein may be made without departing from the spirit of the embodiments described herein. The accompanying claims and their equivalents are intended to cover such forms or modifications as would fall within the scope and spirit of the embodiments described herein.

What is claimed is:

1. An image forming apparatus comprising:

a sheet supply unit comprising a sheet container, the sheet supply unit configured to supply a sheet from the sheet container in a sheet conveyance direction;

a printer configured to form a toner image to the sheet supplied from the sheet supply unit;

a fixing device comprising:

a heater configured to heat the toner image and including a heat generating member having a plurality of heating elements arranged in a first direction that is orthogonal to the sheet conveyance direction, the plurality of heating elements including a first end heating element positioned at a first end of the first direction and a second end heating element positioned at a second end of the first direction opposite to the first end, the first end heating element having a first inner side, and the second end heating element having a second inner side facing towards the first inner side, a fixing belt that is configured to fix the toner image to the sheet after the toner image is heated by the heater, and a pressure roller that is configured to apply a pressure to the fixing belt; and a controller configured to:

receive a printing request, select, after receiving the printing request, a heating element group from the plurality of heating elements, the heating element group comprising the first end heating element and the second end heating element, and control the printer so that the toner image is formed in an area bounded on sides by the first inner side and the second inner side and for a predetermined period of time from a start of heat generation by the heating element group;

wherein the controller is further configured to:

determine a type of the printing request;

select, prior to controlling the printer so that the toner image is formed, one of a plurality of methods of forming the toner image; and control the printer so that the toner image is formed using the one of the plurality of methods of forming the toner image.

2. The image forming apparatus of claim 1, wherein:

the printer is configured to form the toner image with a first orientation relative to a sheet direction of the sheet;

the controller is further configured to:

determine whether a long direction of the sheet with respect to the sheet direction is the first direction, and interface, prior to controlling the printer so that the toner image is formed and after determining that the long direction is the first direction, with the printer so that the printer is configured to form the toner image with a second orientation relative to the sheet direction, the second orientation rotated relative to the first orientation.

3. The image forming apparatus of claim 2, wherein the second orientation is rotated 90 degrees relative to the first orientation.

4. The image forming apparatus of claim 2, wherein:

a first width of the long direction is less than or equal to a second width along the first direction between the first end heating element and the second end heating element; and a third width of a short direction of the sheet with respect to the sheet direction is less than the second width.

5. The image forming apparatus of claim 4, wherein the sheet container comprises:

a first sheet container that is configured to contain the sheet so that the short direction is aligned with the sheet conveyance direction; and a second container that is configured to contain the sheet so that the long direction of the sheet is aligned with the sheet conveyance direction.

6. The image forming apparatus of claim 1, wherein the controller is further configured to:

determine whether a short direction of the sheet with respect to a sheet direction of the sheet is the first direction;

determine image data associated with the printing request after determining that the short direction is the first direction;

determine, based on the image data, whether a condition is satisfied; and interface, prior to controlling the printer so that the toner image is formed and after determining that the condition is satisfied, with the printer so that the printer is configured to form a reduced toner image based on the toner image.

7. The image forming apparatus of claim 6, wherein the reduced toner image is the toner image scaled down.

8. The image forming apparatus of claim 6, wherein:

a first width of the short direction is less than or equal to a second width along the first direction between the first end heating element and the second end heating element; and a third width of a long direction of the sheet with respect to the sheet direction is greater than the second width.

9. The image forming apparatus of claim 6, wherein:

the first inner side is separated from the second inner side by a gap; and the area is bounded on sides by sides of the gap.

10. The image forming apparatus of claim 1, wherein the controller is further configured to determine whether a print job associated with the printing request is completed.

11. A method of forming an image, the method comprising:

supplying, by a sheet container, a sheet in a sheet conveyance direction;

forming, by a printer, a toner image on the sheet;

receiving, by a controller, a printing request;

selecting, by the controller and after receiving the printing request, a heating element group from a heat generating member including a plurality of heating elements arranged in a first direction that is orthogonal to the sheet conveyance direction and including a first end heating element positioned at a first end of the first direction and a second end heating element positioned at a second end of the first direction that is opposite to the first end, the heating element group comprising the first end heating element and the second end heating element, the first end heating element having a first inner side, and the second end heating element having a second inner side facing towards the first inner side;

driving, by the controller, the heating element group to heat a fixing belt and fix the toner image to the sheet;

controlling, by the controller, the printer so that the toner image is formed in an area bounded on sides by the first inner side and the second inner side and for a predetermined period of time from a start of heat generation by the heating element group;

determining, by the controller, a type of the printing request;

selecting, by the controller and prior to controlling the printer so that the toner image is formed, one of a plurality of methods of forming the toner image; and controlling, by the controller, the printer so that the toner image is formed using the one of the plurality of methods of forming the toner image.

12. The method of claim 11, wherein the first inner side is separated from the second inner side in the first direction.

13. The method of claim 11, further comprising:

determining, by the controller, whether a long direction of the sheet with respect to a sheet direction of the sheet is the first direction;

interfacing, by the controller and prior to controlling the printer so that the toner image is formed and after determining that the long direction is the first direction, with the printer so that the printer is configured to form the toner image with a first orientation relative to the sheet direction; and forming, by the printer, the toner image with the first orientation;

wherein the printer is configured to form the toner image with a second orientation relative to the sheet direction after determining that the long direction is not the first direction, the second orientation rotated 90 degrees relative to the first orientation.

14. The method of claim 11, further comprising:

determining, by the controller, whether a short direction of the sheet with respect to a sheet direction of the sheet is the first direction;

determining, by the controller, image data associated with the printing request after determining that the short direction is the first direction;

determining, by the controller and based on the image data, whether a condition is satisfied; and interfacing, by the controller and prior to controlling the printer so that the toner image is formed and after determining that the condition is satisfied, with the printer so that the printer is configured to form a reduced toner image based on the toner image.

15. The method of claim 14, wherein the reduced toner image is the toner image scaled down.

16. An image forming apparatus comprising:

a sheet supply unit configured to provide a sheet in a sheet conveyance direction;

a printer configured to form a toner image to the sheet;

a fixing device comprising:

a plurality of heating elements configured to heat the toner image and arranged in a first direction that is orthogonal to the sheet conveyance direction, the plurality of heating elements including a first end heating element positioned at a first end of the first direction and a second end heating element positioned at a second end of the first direction that is opposite to the first end, the first end heating element having a first inner side, and the second end heating element having a second inner side facing towards the first inner side, a fixing belt that is configured to fix the toner image to the sheet after the toner image is heated by the plurality of heating elements, and a pressure roller that is configured to apply a pressure to the fixing belt; and a controller configured to:

determine a width of the sheet, receive a printing request, control the printer so that the toner image is formed in an area bounded on sides by the first inner side and the second inner side, determine whether a short direction of the sheet with respect to a sheet direction of the sheet is the first direction, determine image data associated with the printing request after determining that the short direction is the first direction, and determine, based on the image data, whether a condition is satisfied.

17. The image forming apparatus of claim 16, wherein:

the printer is configured to form the toner image with a first orientation relative to the sheet direction of the sheet;

the controller is further configured to:

determine whether a long direction of the sheet with respect to the sheet direction is the first direction, and interface, prior to controlling the printer so that the toner image is formed and after determining that the long direction is the first direction, with the printer so that the printer is configured to form the toner image with a second orientation relative to the sheet direction, the second orientation rotated 90 degrees relative to the first orientation.

18. The image forming apparatus of claim 16, wherein:

the controller is further configured to interface, prior to controlling the printer so that the toner image is formed and after determining that the condition is satisfied, with the printer so that the printer is configured to form a reduced toner image based on the toner image; and the reduced toner image is the toner image scaled down.

19. The image forming apparatus of claim 16, wherein:

the plurality of heating elements further includes a central portion heating element disposed between the first end heating element and the second end heating element; and the area is bounded on sides by sides of the central portion heating element.

* * * * *